United States Patent [19]

Polzin et al.

[11] 3,935,758

[45] Feb. 3, 1976

[54] TOOL FOR APPLYING MASKING TAPE TO MOLDINGS

[76] Inventors: Dean A. Polzin, 2033 E. Birch Run Road, Burt, Mich. 48417; Arthur J. Trickey; Arthur M. Trickey, both of 12108 N. Saginaw Road, Clio, Mich. 48420

[22] Filed: Mar. 5, 1975

[21] Appl. No.: 555,579

[52] U.S. Cl. ..... 81/3 R

[51] Int. Cl.[2] ..... B65H 75/40

[58] Field of Search ... 226/190, 191; 242/96, 55.53, 242/55.2; 30/124; 81/3 R

[56] References Cited

UNITED STATES PATENTS

| | | | |
|---|---|---|---|
| 1,348,079 | 7/1920 | Bir | 242/96 |
| 3,112,225 | 11/1963 | Harms | 242/96 |

*Primary Examiner*—Al Lawrence Smith
*Assistant Examiner*—Roscoe V. Parker
*Attorney, Agent, or Firm*—Krass & Young

[57] ABSTRACT

A tool for applying masking tape to automotive body moldings is formed about a frame having a tape reel support at one end and a tape applying roller at the other end. The tape applying roller has a resilient cylindrical surface with a thin steel flange at its outer edge. Two handle sections are attached to the frame allowing it to be grasped in two hands. The flange is inserted between an edge of the molding and the supporting body section to pull the edge slightly away from the body and guide the tool along the molding and the resilient roller section presses the tape over the exposed molding edge.

10 Claims, 4 Drawing Figures

FIG. 1
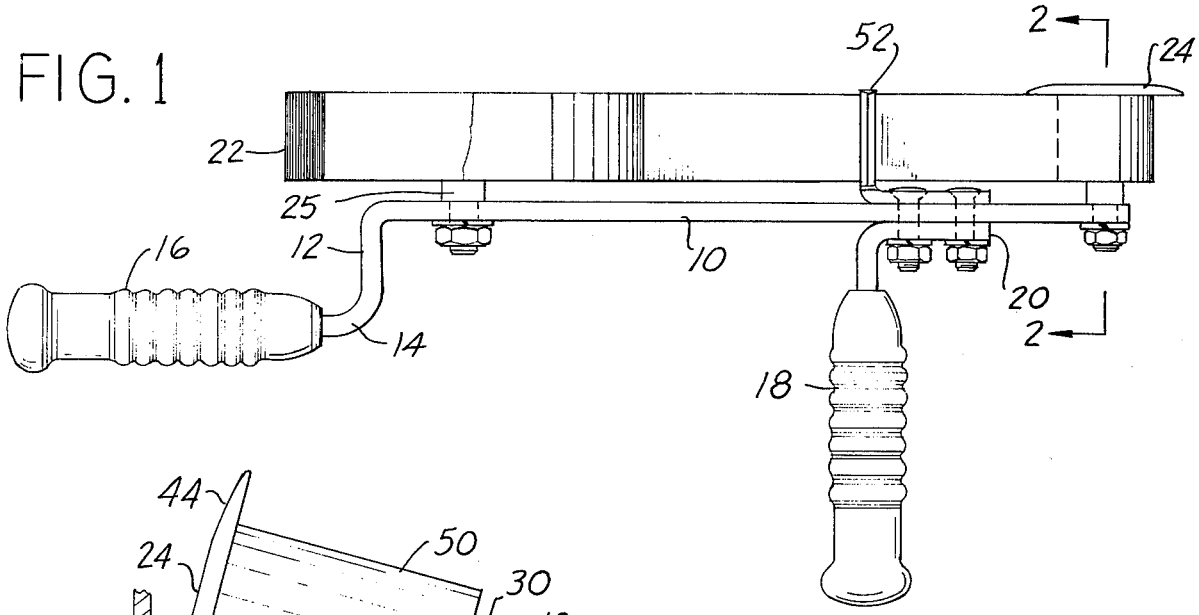
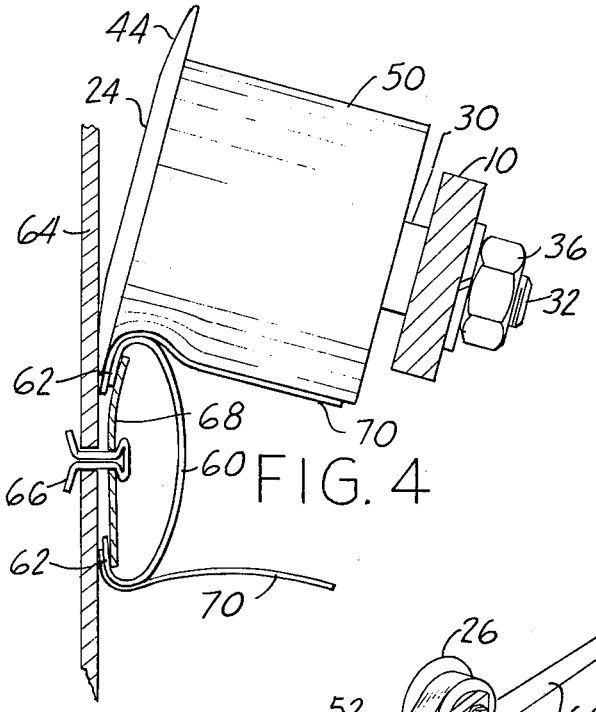
FIG. 4
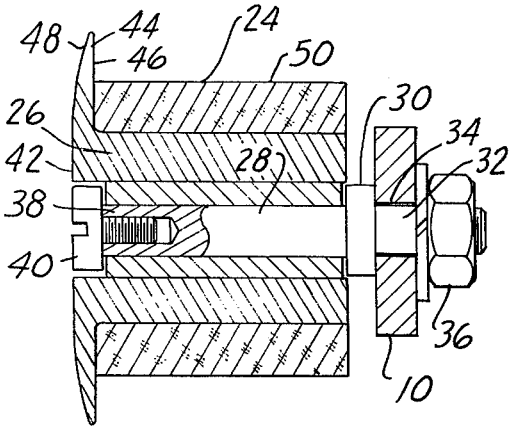
FIG. 2
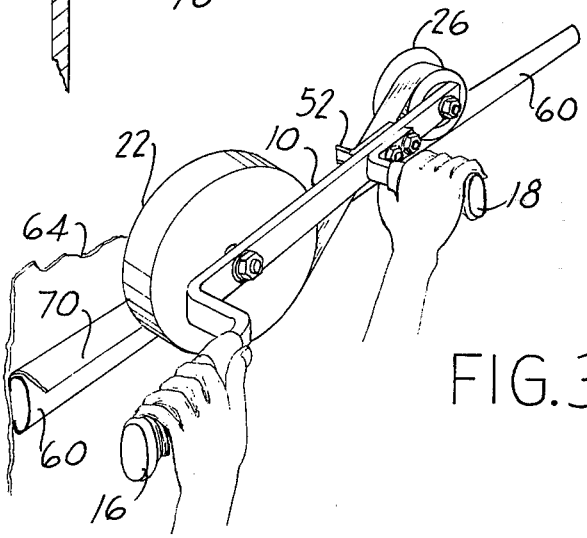
FIG. 3

TOOL FOR APPLYING MASKING TAPE TO MOLDINGS

BACKGROUND OF THE INVENTION

1. Field of the Invention

This invention relates to a tool for applying masking tape to decorative moldings.

2. Prior Art

A variety of tools exist for applying masking tape, from a roll, to a surface to be painted. Certain of these tools employ frames having tape reels rotatably supported at one end and a roller supported at the opposite end. The end of the tape section is pulled from the reel and applied to the surface and the roller is laid over the tape end. The tool is then drawn away from the tape end, reeling out a length of tape and pressing it against the surface with the roller. Many of these tools have also been equipped with cutting edges supported on the frame between the reel and the roller which may be used to cut the applied section of tape from the section still on the reel.

When tape is applied to automotive molding to protect the molding during a subsequent painting operation, it is common practice to apply two tape sections to each molding, one section extending along each of the two opposed edges of the molding. The tape sections are then folded, one over the other, to protect the entire molding. It is difficult to apply this tape so that its edge extends right to the edge of the molding, particularly with the prior art tape applying devices. Accordingly, these masking operations have usually been performed manually and have been expensive because of the slow nature of the process.

The present invention is accordingly directed toward an improved form of tape applying tool, especially adapted for applying tape to the edges of automotive moldings.

SUMMARY OF THE INVENTION

Tools formed in accordance with the present invention are intended to take advantage of the particular manner in which automotive moldings are typically secured to body surfaces. The moldings are usually channel shaped and have opposed inturned flanges that abut the body surface. They are retained to the body by clips which extend from the body and lock into the moldings between the underside of their central web section and the inturned flanges. In this manner the outer surfaces of the flanges are pressed against the body surface but they are not directly connected thereto.

The tools formed in accordance with the present invention include a member adapted to be inserted between an edge of the molding, at the inturned flange, to both slightly separate the flange from the body so that the tape may be applied along the full exposed section of the molding, and also to guide the movement of the tool along the molding. The tool has a unique handle configuration which allows it to be grasped in two hands and pushed along the molding in such a manner that the molding to be taped is readily visible immediately in front of the roller.

In the preferred embodiment of the invention, which will subsequently be disclosed in detail, the applying roller has a cylindrical section formed of resilient material adapted to press against a section of tape being withdrawn from the reel and a thin disc-like flange supported on the far end of the roll axis from the flange and projecting radially outward slightly beyond the surface of the resilient section. The outer end of the flange is tapered to a thin edge adapted to be inserted between the inturned flange of the molding and the supporting body section. This insertion pulls the molding edge slightly away from the body so that the tape may be applied along the full exposed surface of the molding. The toll is then moved along the molding under the guidance of the flange and tape withdrawn from the reel is pressed against the molding edge by the resilient section. The resilient section conforms to the molding's end configuration to press one edge of the tape against the fully exposed convex molding edge. After two sections of tape are thus applied to the two opposed edges of the molding, the free edges of the tapes are folded over to completely cover the molding.

The unique handle arrangement consists of a first handle section projecting longitudinally parallel to and slightly displaced from the frame axis, that is, aligned normal to the rotational axes of the reel and the roller. The second handle section extends from the frame normally to the frame axis in a direction opposite to the reel and the roller axes. The right-handed operator grasps the first handle section in his left hand and the second handle section in his right hand when using downward force. When using upward force, he would either invert the roll of tape to be dispensed, or invert the tape dispensing tool and change hands on the handles, pushing in the opposite direction. The tool may then be moved along a molding with the edge of the disc-like flange inserted between the molding and the body, to both slightly separate the molding from the body and to guide the motion of the tool. The tool is equally usable by right-handed or left-handed operators, depending on the placement of the tape on the rollers.

Other objectives, advantages and applications of the present invention will be made apparent by the following detailed description of a preferred embodiment of the invention. The description makes reference to the accompanying drawings in which:

FIG. 1 is a perspective view of a tape applying tool formed in accordance with the present invention.

FIG. 2 is a detailed sectional view of the tape apply roller of the preferred embodiment, taken along line 2—2 of FIG. 1;

FIG. 3 is a perspective view of the tool being used to apply masking tape to the edge of an automotive molding; and FIG. 4 is a sectional view through the molding and adjacent body section and the tape applying roller illustrating the relation between the tool and the work.

The preferred embodiment of the invention is built about a frame 10 formed of metal rod with a rectangular cross-section. The frame is bent at 90° adjacent one end to form a normally extending section 12 and the end of that section is rebent to form a section 14 which extends parallel to and separated from the central frame section 10.

A first elongated handle section 16, preferably formed of plastic, is attached to the frame section 14 so that it projects along the axis of that section. A second, similar handle member 18 is attached to the frame section 10 by an L-shaped metal bracket 20 that has its free surface welded or otherwise fastened to the frame 10 so that the handle section 18 projects normally to the frame.

A tape reel 22 is rotatably supported on an axle 25 which projects from the frame section 10 on the opposite side of the handle 18, near the bent section 12. The axle 25 of the tape reel is preferably parallel to the axis of the elongated handle member 18. The tape reel is designed so that the tape rolls may be readily loaded and unloaded from the reel.

A tape applying roller, generally indicated 24 is supported at the far end of the frame from the reel 22, beyond the handle 18. Reel 24 is illustrated in cross-section in FIG. 2. It consists of a cylindrical steel section 26 rotatably supported on a cylindrical shaft 28. The shaft has a cylindrically enlarged section 30 at one end with shoulders that bear against the side of the roll section 26 and the frame 10. A reduced diameter threaded section 32 projects through a hole 34 formed in the frame 10 and the shaft is affixed therein with a nut 36 and a suitable lock washer. The far end of the shaft 20 has a threaded hole 38 formed centrally which receives a locking nut 40. The head of the locking nut fits within a circular recess 42 formed in the outer side of the roll section 26.

The roll section 26 has a radially outward extending flange or disc 44 formed on the side remote from the frame 10. The flange 44 has a flat inner surface 46 which extends normally to the roll axis and a tapered outer surface 48 so that the flange thins to a slight rounded edge at its radially outer perimeter.

The cylindrical surface of the section 26 is covered with a resilient rubber-like material 50. The flange 44 extends beyond this resilient cover.

The preferred form of the tool has an elongated double-sided cutting edge 52 affixed to the frame 10 and projecting parallel to the rotational axes of the reel 22 and the roller 24 between the two.

The tool is used by withdrawing a section of tape from a roll supported on the reel 22 and positioning the end of the tape section on the surface to be covered with the tape. The tool is grasped with the left hand around the handle member 16 and the right hand on the second handle member 18, for application to the top edge of a molding, as shown in FIG. 3. The tool is drawn away from the secured tape end so as to withdraw tape from the reel and the end is wrapped over the resilient cover 50 of the roller 24 so the bottom of the roller can be pressed against the tape. The tool is then moved forwardly to lay down a layer of tape which is pressed against the surface by the resilient reel section. The tape section may be separated from the reel by pulling the section between the reel 22 and roller 24 against the cutting edge 52.

A tool is used to apply masking tape to decorative moldings of the type used with automobiles in the manner illustrated in FIGS. 3 and 4. The typical molding consists of a steel channel section having a web 60 and a pair of inwardly directing flange ends 62. The molding is adapted to be secured to a supporting surface such as an automobile door 64 by a clip including a section 66 which passes through a hole in the body section and an interior clip member 68 which bears against the inner sections of the inturned flanges 62. The outer sides of the flanges are thus resiliently pressed against the body section. Because of this convex shape of the edges of the molding it is difficult to apply masking tape so that it fully covers the exposed section of the edges.

To use the tool to apply tape to the molding a section of tape is first withdrawn from the reel 22 and over the roller 24, and its adhesive side is correctly positioned on the molding. The tool is then positioned so that the flange 44 is inserted between the inturned flange 60 of the molding and the body section 64. As shown in FIG. 4 this compresses the resilient section 50 and conforms the edge of the tape section to the molding edge. The tool is then pushed along the molding under the guidance afforded by the flange 44 and the withdrawn tape is pressed against the molding edge. When the full length of the molding edge has been covered the tape is drawn against the cutting edge 52 to cut it off from the section of the roll.

The same process is then used to apply tape to the opposite edge of the same molding, either inverting the tape roll or inverting the tool and changing hands on the handle and moving in an opposite direction so that the handles 16 and 18 clear the body section. FIG. 4 illustrates the tape being applied to the top edge of a molding after a section 70 has been applied to the bottom edge. After tape has been applied to both edges the free edges of the tape are folded over to fully cover the molding.

The tool is simple in construction so as to be low in cost and reliable in operation and it saves appreciable labor in applying masking tape to automotive molding sections.

Having thus described our invention, we claim:

1. A tool for applying masking tape to the exposed surfaces of moldings attached to supporting surfaces so that at least one longitudinal edge of the molding is supported adjacent to but unattached to the supporting surface, comprising: an elongated frame member; a tape support reel rotatably supported adjacent one end of the frame member so that the reel axis extends normally to the frame member; an applying roller rotatably supported adjacent the opposite end of the frame with its rotational axis parallel to and on the same side of the frame as the rotational axis of the tape reel; a roller having a resilient surfce and a flange member having its edge extending radially outward beyond the resilient surface; and handle means connected to the frame for supporting the tool, whereby the flange may be inserted between the longitudinal edge of a molding and the supporting surface so that the resilient section of the roller presses against the edge of the molding to allow the length of tape to be attached to the molding edge and pressed against the edge by the resilient section of the roller.

2. The tool of claim 1 wherein the flange is disposed at the edge of roller remote from the frame.

3. The tool of claim 1 wherein said flange is tapered so that its thinnest section is on its radially outer edge.

4. The tool of claim 3 wherein the surface of the flange adjacent to the resilient section extends substantially normal to the rotational axis of the roll.

5. The tool of claim 1 wherein said handle means comprises a pair of handle sections, one extending generally parallel to the frame from the reel supporting end of the frame, and the other extending generally normally to the frame between the points of support of the reel and the roller.

6. The tool of claim 5 wherein the handle member that extends generally normally to the extension of the frame extends generally parallel to the axes of the reel and the roller from the side of the frame opposite to that on which the reel and roller are supported.

7. The tool of claim 1 further including an elongated cutting edge fixed to the frame to extend parallel to the axes of the reel and the roller, attached to frame between the reel and roller on same side thereof of the reel and roller.

8. The tool of claim 1 wherein the flange has a planar surface extending normally to the axis of rotation of the roller and abutting a surface of the resilient section which also extends normally to the axis of rotation of the roller, so that when resilient section is compressed the exposed area of said surface on the flange increases.

9. A toll for applying an elongated strip of tape to a supporting surface comprising: an elongated frame member; a tape reel rotatably supported about an axis attached to one end of the frame; a roller rotatably supported on an axis attached to the opposite end of the frame, the rotational axes of the reel and the roller being parallel to one another; a first handle member affixed to the frame at the end of the frame adjacent to the reel member and extending parallel to the frame and a second handle member attached to the frame between the points of attachment of the additional axes for the reel and the roller, said second handle member extending normally from the frame member from the side opposite the side of the frame to which the axes for the reel and the roller are attached.

10. The tool of claim 9 wherein the roller includes a thin disc disposed at the outer end of the roll rotational axis and a resilient section, having an outer diameter smaller than the outer diameter of the flange, extending between the flange and the frame.

* * * * *